US008172230B2

(12) United States Patent
Killgo et al.

(10) Patent No.: US 8,172,230 B2
(45) Date of Patent: May 8, 2012

(54) BOARD GAME PLAYING SYSTEM AND METHOD OF INCORPORATING CITY LANDMARKS

(75) Inventors: Yvonne T. Killgo, Valdosta, GA (US); Nancy S. Parker, Valdosta, GA (US)

(73) Assignee: Par-Go, LLC, Valdosta, GA (US)

( * ) Notice: Subject to any disclaimer, the term of this patent is extended or adjusted under 35 U.S.C. 154(b) by 0 days.

(21) Appl. No.: 11/465,261

(22) Filed: Aug. 17, 2006

(65) Prior Publication Data

US 2008/0042349 A1 Feb. 21, 2008

(51) Int. Cl.
*A63F 3/00* (2006.01)

(52) U.S. Cl. ..... 273/248; 273/254

(58) Field of Classification Search ..... 273/254, 273/248

See application file for complete search history.

(56) References Cited

U.S. PATENT DOCUMENTS

| | | | | | |
|---|---|---|---|---|---|
| 1,136,106 | A | | 4/1915 | Coming | |
| 2,163,011 | A | | 6/1939 | Schaub | |
| D199,400 | S | | 10/1964 | Bernstein | |
| 3,990,707 | A | * | 11/1976 | Terilli | 273/256 |
| 4,054,289 | A | * | 10/1977 | Burkett | 273/254 |
| 4,076,250 | A | | 2/1978 | Azcarate | |
| 4,375,889 | A | * | 3/1983 | Burkett | 273/254 |
| 5,002,283 | A | * | 3/1991 | Langham et al. | 273/252 |
| 5,156,407 | A | | 10/1992 | Moore | |
| 5,211,402 | A | * | 5/1993 | Ferguson et al. | 273/249 |
| 5,350,179 | A | * | 9/1994 | Hill et al. | 273/249 |
| 5,445,390 | A | | 8/1995 | Dutton et al. | |
| 5,478,086 | A | | 12/1995 | Aylett | |
| 5,810,359 | A | * | 9/1998 | Wilkins et al. | 273/256 |
| 5,876,035 | A | * | 3/1999 | Medina, Jr. | 273/254 |
| 5,876,211 | A | | 3/1999 | Schmoyer et al. | |
| 5,988,642 | A | * | 11/1999 | Ziemba et al. | 273/251 |
| 6,164,650 | A | * | 12/2000 | Wilkins et al. | 273/256 |
| 6,224,056 | B1 | | 5/2001 | Jones | |
| 6,412,777 | B1 | * | 7/2002 | Rossi | 273/243 |
| 6,672,590 | B1 | | 1/2004 | Olsen et al. | |
| 6,796,561 | B2 | * | 9/2004 | Bedford | 273/243 |
| 6,871,853 | B2 | | 3/2005 | Bedford | |
| 6,974,131 | B2 | | 12/2005 | Frank | |
| 6,978,999 | B2 | | 12/2005 | Kline et al. | |
| 2003/0085519 | A1 | | 5/2003 | Bedford | |
| 2005/0029737 | A1 | | 2/2005 | Mattie | |

FOREIGN PATENT DOCUMENTS

| | | | |
|---|---|---|---|
| FR | 2558733 | A1 * | 8/1985 |
| GB | 2382995 | | 6/2003 |
| GB | 2391490 | | 2/2004 |

* cited by examiner

*Primary Examiner* — Vishu K. Mendiratta
(74) *Attorney, Agent, or Firm* — Alexander P. Brackett; Middleton Reutlinger

(57) ABSTRACT

A novel board game and a method of playing said game is herein described. The invention provides players an opportunity to traverse a town or city represented symbolically on the game board by a plurality of landmark buildings and locales that can be found throughout a typical town. Accordingly, the present invention includes both an apparatus with which the game is played as well as a method for playing the game according to the rules of play.

8 Claims, 15 Drawing Sheets

| | |
|---|---|
| GASSY GAS STATION | PLAIN PLANE AIRPORT |
| GETT'S PETS | Baker B. Bakery |
| CHERUB CHURCH | BLAZE FIRE STATION |
| I. IMAGINE CITY HALL | PARGO PARK |
| SMILE E. WHITE DENTIST | SUPER SUPER MARKET |
| DR. DOC DOCTOR OFFICE | YUMMY YUMMY RESTAURANT |
| ZINGGY ZANGGY ZOO | HELPING HANDS HOSPITAL |
| TOO COOL SCHOOL | LINGO LINK LIBRARY |
| PLAY POWER POLICE STATION | TOP SHOP MALL |

FIG. 11

IT'S VACATION TIME!

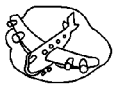

GO TO THE AIRPORT
TO PURCHASE A TICKET!
COLLECT A TOKEN!

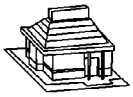

GO TO THE RESTAURANT!
A HEALTHY *MEAL* IS A GOOD *DEAL!*
COLLECT A TOKEN!

YOU HAVE A NEW BABY SISTER OR *BROTHER*
GO TO THE HOSPITAL TO VISIT *MOTHER!*
COLLECT A TOKEN!

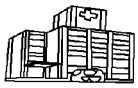

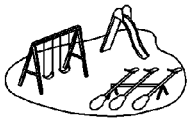

GO TO THE CITY PARK AND PLAY!
DON'T STAY ALL *DAY!*
COLLECT A TOKEN!

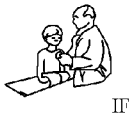

IF YOU HAVE TO *THROW-UP,*
IT'S TIME FOR A *CHECK-UP!*
GO TO THE DOCTOR'S OFFICE.
COLLECT A TOKEN!

FOR A FIRE SAFETY *TIP*
GO TO THE FIRE STATION
ON A FIELD *TRIP!*

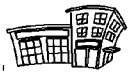

COLLECT A TOKEN!

LUCKY YOU!!!

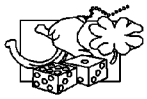

THIS MAY HELP YOU TO *WIN!*
ROLL THE DICE *AGAIN!*
GO THAT NUMBER OF SPACES!

DO YOU HEAR A ROAR IN YOUR *BELLY?*
GO TO THE SUPER MARKET
FOR PEANUT BUTTER AND *JELLY!*
COLLECT A TOKEN!

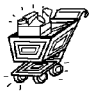

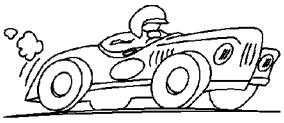

NO TIME TO BE *SLOW!*
ONE, TWO, THREE, *GO!*
MOVE THREE (3) SPACES FORWARD!

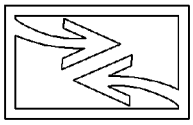

IT'S TIME FOR A SWITCH-A- *ROO!*
EXCHANGING PLACES IS WHAT YOU *DO! GO*
SWITCH PLACES WITH A PLAYER!

FIG. 12

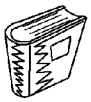

IT'S STORYTIME!
BOOKS ARE FUN TO *READ.*
GO TO THE LIBRARY
BUT DON'T *SPEED!*
COLLECT A TOKEN!

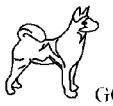

GO TO THE PET *SHOP*
JUST FOR A FUN *STOP!*
COLLECT A TOKEN!

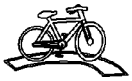

HERE'S NEWS YOU'LL *LIKE--*
THE POLICE HAVE FOUND YOUR MISSING *BIKE!*
GO TO THE POLICE STATION.
COLLECT A TOKEN!

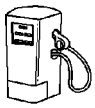

RUNNING LOW ON GAS?
THE STATION YOU BETTER NOT *PASS.*
GO TO THE GAS STATION
AND FILL'ER UP!
COLLECT A TOKEN!

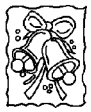

YOU'RE INVITED TO A WEDDING.
GO TO THE CHURCH.
DON'T BE *LATE!* IT'S AN IMPORTANT *DATE.*
COLLECT A TOKEN!

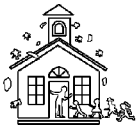

GRAB YOUR BOOKS TO *BRING* -
THE BELL IS ABOUT TO *RING!*
GO STRAIGHT TO SCHOOL!
COLLECT A TOKEN AND GOOD GRADES!

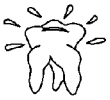

IT'S TIME FOR YOUR DENTIST
APPOINTMENT!
YOUR TOOTH COULD BE LOOSE OR *BROKEN?*
SMILE! GO COLLECT A *TOKEN!*

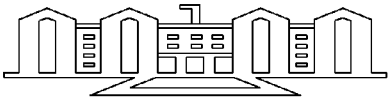

GO TO THE *MALL* AND HAVE A *BALL!*
COLLECT A TOKEN!

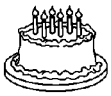

DID SOMEONE *SAY*
IT'S YOUR BIRTHDAY *TODAY?*
GO TO THE BAKERY.
CHOOSE A CAKE AND GET A TOKEN!

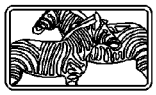

GO.....
HAVE FUN AT THE *ZOO!*
SEE THE TIGERS AND ZEBRAS, *TOO!*
COLLECT A TOKEN!

FIG. 13

SAFETY CHECK!
YOUR SEAT BELT - YOU DID NOT *BUCKLE,*
THIS FINE WILL NOT MAKE YOU *CHUCKLE!*
MOVE BACK ONE (1) SPACE AND PARK.
WAIT FOR YOUR NEXT TURN.

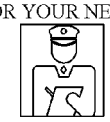

YOUR LIBRARY BOOK IS *OVERDUE!*
YOU HAVE TO PAY A FINE -- IT'S *TRUE!*

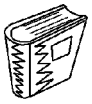

PARK IN FRONT OF THE LIBRARY.
YOUR FINE IS TO LOSE ONE (1) TURN.

BY ORDER OF THE *MAYOR*
EXCHANGE PLACES WITH A *PLAYER!*
PARK YOUR VEHICLE AND WAIT FOR
YOUR NEXT TURN!

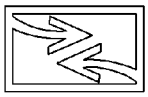

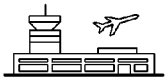

GRANDMOTHER'S PLANE IS *LATE!*
PARK IN FRONT OF THE AIRPORT AND *WAIT!*
STAY PARKED UNTIL YOUR NEXT TURN.

UP AHEAD IS A CONSTRUCTION *SITE!*
THE CREW'S WORKED ALL *NIGHT!*
MOVE BACK TWO (2) SPACES AND PARK.

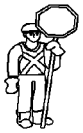

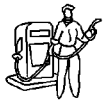

PARK AT THE GAS STATION.
YOUR GAS TANK IS *LOW!*
LOSE ONE (1) TURN
BEFORE YOU FILL UP AND *GO!*

YOU HAVE A PARKING TICKET *FINE.*
YOU PARKED ON A YELLOW *LINE!*
PARK IN FRONT OF THE POLICE STATION.
LOSE ONE (1) TURN

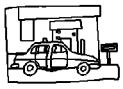

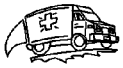

THE AMBULANCE IS BEHIND *YOU!*
DO YOU KNOW WHAT TO *DO?*
MOVE OVER, PARK, AND LET IT
THROUGH!

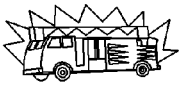

MOVE BACK ONE (1) SPACE TO *STAY.*
THE FIRE TRUCK IS COMING YOUR *WAY!*

PARK UNTIL YOUR NEXT TURN.

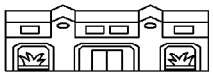

IN THE *MALL'S* PARKING *LOT.*
YOU'LL FIND AN EMPTY *SPOT!*
PARK AND SHOP. LOSE ONE (1) TURN.

FIG. 14

A MOVING VAN IS ON THE *ROAD.*
WAIT FOR WORKERS TO *UNLOAD!*

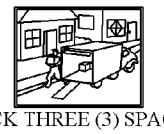

MOVE BACK THREE (3) SPACES AND PARK!

ARE YOU DRIVING TOO *FAST?*
THIS TIME MIGHT BE YOUR *LAST!*

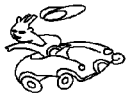

YOUR SPEEDING TICKET FINE IS TO MOVE BACK THREE (3) SPACES AND PARK!

TOO BAD YOUR TIRE IS *FLAT!*
NOW YOU'LL HAVE TO FIX *THAT!*
PARK HERE AND LOOSE ONE (1) TURN.

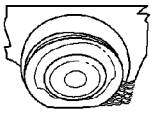

THERE'S A WRECK IN THE NEXT *SPACE!* MOVE YOUR VEHICLE TO A SAFE *PLACE!*

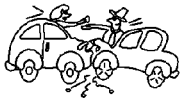

MOVE BACK TWO (2) SPACES AND PARK!

YOU DO NOT HAVE TO *PAY!*
FREE PARKING *TODAY!*
PARK ONE (1) SPACE FORWARD OR ONE (1) SPACE BACK.

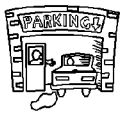

OOPS!
SOMEONE GOT YOUR PARKING *SPACE!*
LOOK FOR ANOTHER *PLACE!*
MOVE BACK TWO (2) SPACES TO PARK!

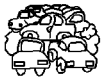

MOVE BACK ONE (1) SPACE
YOUR PARKING METER NEEDS A *DIME!*

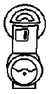

THIS METER HAS EXTRA *TIME!*
PARK UNTIL NEXT TURN!

DADDY'S TRUCK IS *STUCK!*
A BIT OF BAD *LUCK!*

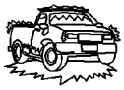

PARK AND LOSE ONE (1) TURN!

TAKE YOUR *BUNCH*
FOR A QUICK *LUNCH!*
PARK AT THE RESTAURANT!
WAIT FOR YOUR NEXT TURN.

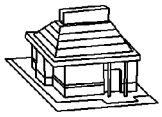

WHAT'S ALL YOUR *FUSS?*
YOU MISSED THE SCHOOL *BUS!!*

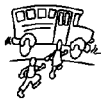

PARK UNTIL YOUR NEXT TURN!

FIG. 15

BOARD GAME PLAYING SYSTEM AND METHOD OF INCORPORATING CITY LANDMARKS

BACKGROUND OF THE INVENTION

1. Field of the Invention

The present invention relates generally to a board game system and method for playing said game. More particularly, the invention relates to a board game capable of being played by multiple players wherein the board is representative of a layout of a town or city, either real or imagined, including a plurality of landmark buildings and locales to be visited by each player in the process of playing.

2. Description of the Related Art

Various and sundry board games are well known in the prior art for providing players with entertainment while they traverse a path, or a variety of intersecting paths according to a set of rules that govern the player's movements around the board. Typically, each player is represented by a game piece that is placed on the board to mark the player's progress through the game. Some prior art board games utilize question or activity cards that require a player to provide a correct answer or perform a task to progress in the game. U.S. Pat. No. 6,978,999 to Kline et al. provides for a set of cards which requires players to act out roles prior to advancing a game piece along the game board.

Additionally, prior art board games are known to use playing boards that are representative of fanciful locations or landscapes and game boards that are representative of historical locales. The enduringly popular MONOPOLY® game has as its setting depression-era Atlantic City, N.J. U.S. Pat. No. 6,672,590 to Olsen et al. teaches a board game having a game board that requires players to navigate a generic town using a "Hometown USA" motif.

The board game system of the present invention introduces players to either a fanciful or actual city or town constructed from a plurality of landmark buildings and locales and is capable of being played by players from young children to adults by the use of visual indicia and symbols throughout a plurality of instruction cards. Furthermore, the instant invention is capable of being played by younger players who may lack the reading skills to actively participate in many prior art board games.

SUMMARY OF THE INVENTION

The invention disclosed herein provides a novel board game and a method of playing said game which provides players an opportunity to traverse a town or city represented symbolically on the game board by a plurality of landmark buildings and locales that can be found throughout a typical town. Accordingly, the present invention includes both an apparatus with which the game is played as well as a method for playing the game according to the rules of play.

The apparatus incorporates a game board having a plurality of spaces printed thereon that make up a plurality of roads denoting various routes around the game board. A perimeter road is provided, as well as a number of intersecting interior roads that provide alternative routes through the town. A plurality of landmark buildings and locales are positioned along the various roads, each of which a player must visit prior to advancing to a winner's space. Additionally, a plurality of color-coded tokens are placed either on or proximate each landmark, corresponding to a colored game piece chosen by each player to represent the player on the game board. Players collect the tokens as they advance to each subsequent landmark by rolling a pair of dice. Once a player has collected each token corresponding to the color of his or her playing piece, the player may then advance to a winner's space to win the game.

The instant invention also includes a plurality of instruction cards that may be strategically situated on a space or spaces provided on the game board to enable ready access thereto. The instruction cards may comprise a plurality of different types of instructions that either reward a player or thwart their advancement through the game board. Furthermore, the instruction card types are color-coded to correspond to a plurality of colored spaces disposed at various points on the roads of the game board. When a player lands on a colored space, they are obligated to follow the instructions on the next card of the corresponding color. Players advance through the plurality of spaces that denote the town roads by rolling a pair of dice, thence advancing the number of spaces indicated by the roll.

Furthermore, the game board of the present invention is capable of being customized by the players prior to beginning game play by placement of a plurality of different building types, and colors, as well as various plant, animal and vehicular ornamentations along the board surface. This feature of the invention permits the players to construct a game board that symbolizes a different customized town each time the game is played, which makes the invention ideally suited for children with developing imaginations as well as adults.

BRIEF DESCRIPTION OF THE DRAWING FIGURES

FIG. 11 is a plan view of a plurality of banners for customizing landmarks in accordance with one embodiment of the present invention.

FIG. 12 is a view of a plurality of GO card instructions in accordance with one embodiment of the present invention.

FIG. 13 is a view of a plurality of GO card instructions in accordance with one embodiment of the present invention.

FIG. 14 is a view of a plurality of PARK card instructions in accordance with one embodiment of the present invention.

FIG. 15 is a view of a plurality of PARK card instructions in accordance with one embodiment of the present invention.

DETAILED DESCRIPTION OF THE PREFERRED EMBODIMENT(S)

Referring now to drawing FIGS. 1-9, and in accordance with a preferred constructed embodiment of the present invention, a novel board game 10 for becoming familiar with various landmark features of a city or town and a method of playing said board game is herein described.

The board game 10 may comprise a game board 20, best seen in its various embodiments in drawing FIGS. 1-8, comprising a playing surface 22 on one side thereof, the playing surface 22 being marked or printed with a plurality of playing spaces 24 that generally interconnect to form a plurality of roads or paths around game board 20. The game board 20 in one embodiment of the invention is constructed of either a pliable or a foldable material to facilitate storage while maximizing board size.

The plurality of spaces 24 on game board 20 are situated thereon to form a plurality of roads or streets. In one embodiment of the present invention, the roads or streets are not named, thereby encouraging players to name the roads according to the roads present in their town, or a town or city with which they may be familiar, in accordance with various landmark buildings and features that are situated at various positions around game board 20, as will be discussed in greater detail herein below. As such, no street names appear on game board 20. However, for purposes of clarity in the explication of the present invention, the streets on game board 20 have been assigned descriptive names according to their locations and features as viewed in FIG. 1.

Figure 1:
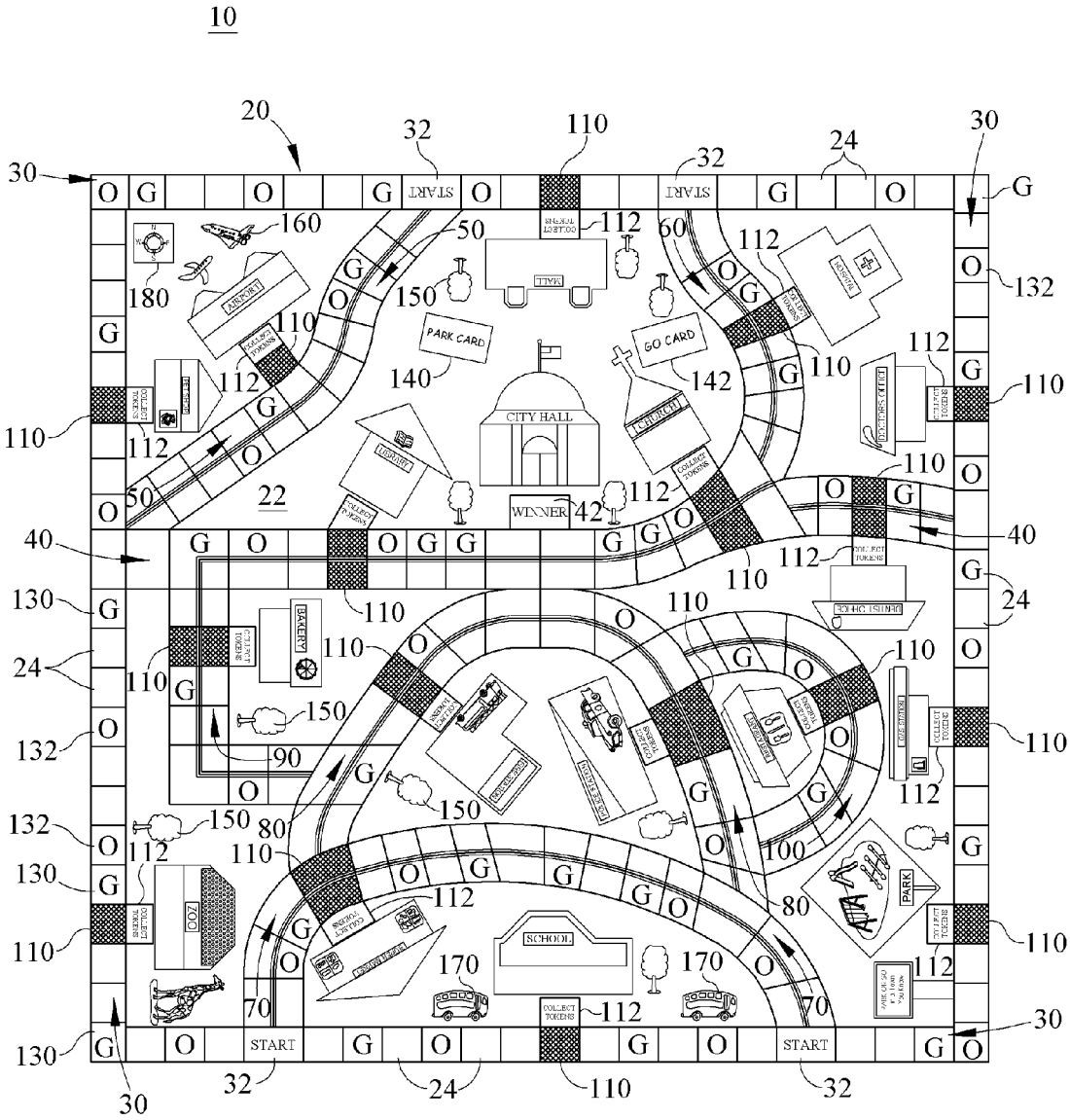
FIG. 1 is a plan view of a game board in accordance with one embodiment of the present invention.

Proximate the exterior edges of game board 20 is situated an outer perimeter road 30, denoted by arrows thereon as shown in FIG. 1. PERIMETER ROAD 30 is comprised of a plurality of spaces 24, including four (4) START spaces 32 that are strategically situated at the intersection of PERIMETER ROAD 30 with other roads that lead to the interior of game board 20. Furthermore, START spaces 32 may be color-coded with four different colors to correspond to the colors of a plurality of game pieces 38, best seen in FIGS. 9 and 10.

In one embodiment of the present invention game pieces 38 comprise three dimensional cars sized to fit within a space 24, each colored to correspond to a start space 32 color. As an example, cars 38 (or game pieces 38) and start spaces 32 may be colored red, green, yellow, and blue, although this color scheme is exemplary only and should not be seen as limiting of the invention since a wide variety of colors may be employed without departing from the scope thereof.

A MAIN STREET 40 bisects the game board 20 from one side of PERIMETER ROAD 30 to another side thereof. As can be seen in FIG. 1, MAIN STREET 40 is proximate several landmark buildings including CITY HALL, although the location of the buildings may be customized, as will be discussed in further detail herein below. Additionally, a WINNER's space 42 is located on MAIN STREET 40, proximate CITY HALL, which space is the ultimate object of the method of playing the game. As shown in the drawing Figures, MAIN STREET 40 comprises twenty (20) two-lane spaces. MAIN STREET 40 intersects an AIRPORT HIGHWAY 50 that runs between a portion of PERIMETER ROAD 30 and MAIN STREET 40. AIRPORT HIGHWAY 50, depicted in FIG. 1, is a road comprising a plurality of spaces 24, having a curvature and on which, appropriately enough, the "PLAIN PLANE AIRPORT" is located.

Figure 3:
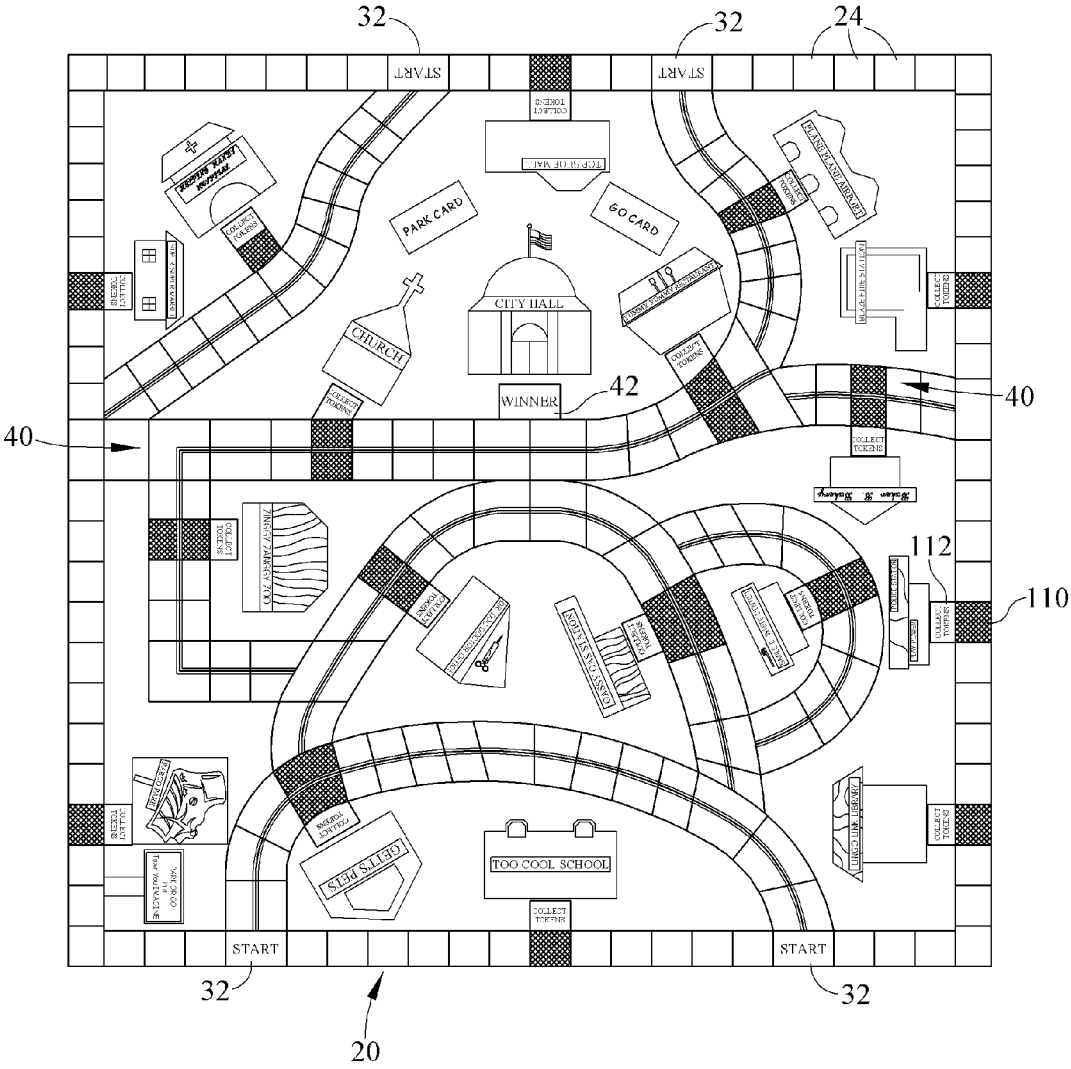
FIG. 3 is a plan view of a game board having landmarks placed around the roads in accordance with one embodiment of the present invention.
Figure 4:
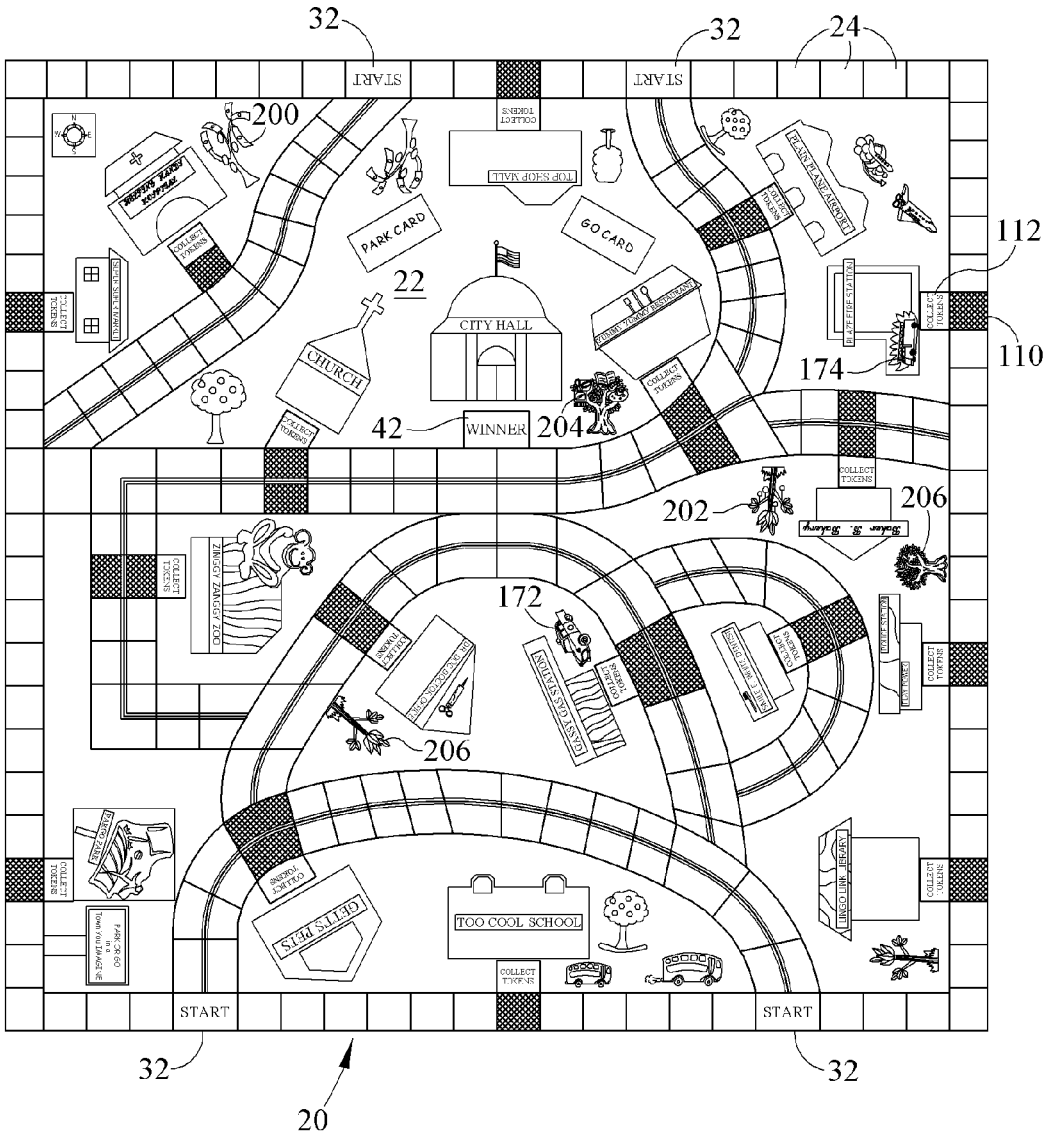
FIG. 4 is a plan view of a game around the roads in accordance with an alternative embodiment of the present invention.
Figure 5:
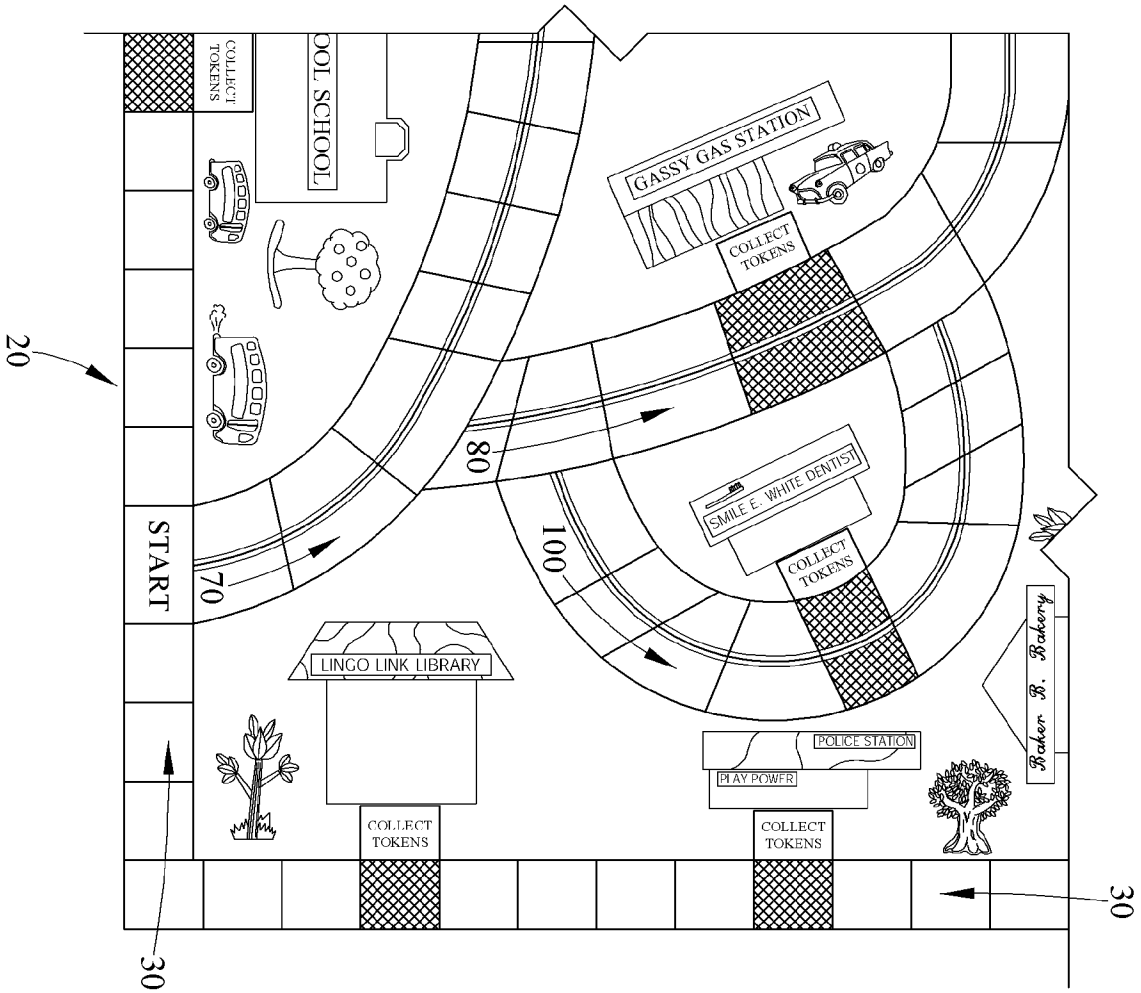
FIG. 5 is a sectional plan view of the game board of FIG. 4 in accordance with one embodiment of the present invention.
Figure 6:
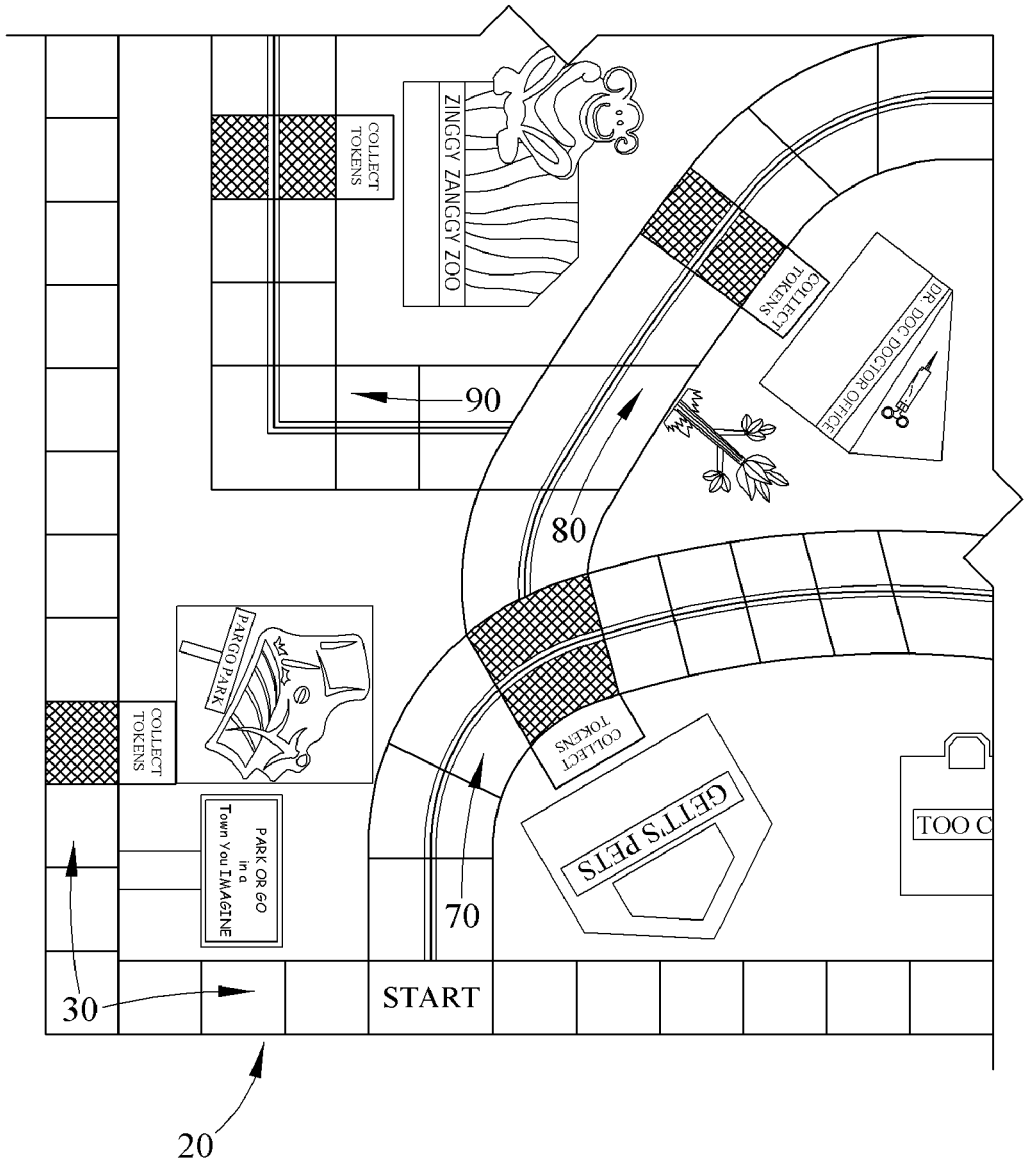
FIG. 6 is a sectional plan view of the game board of FIG. 4 in accordance with one embodiment of the present invention.
Figure 7:
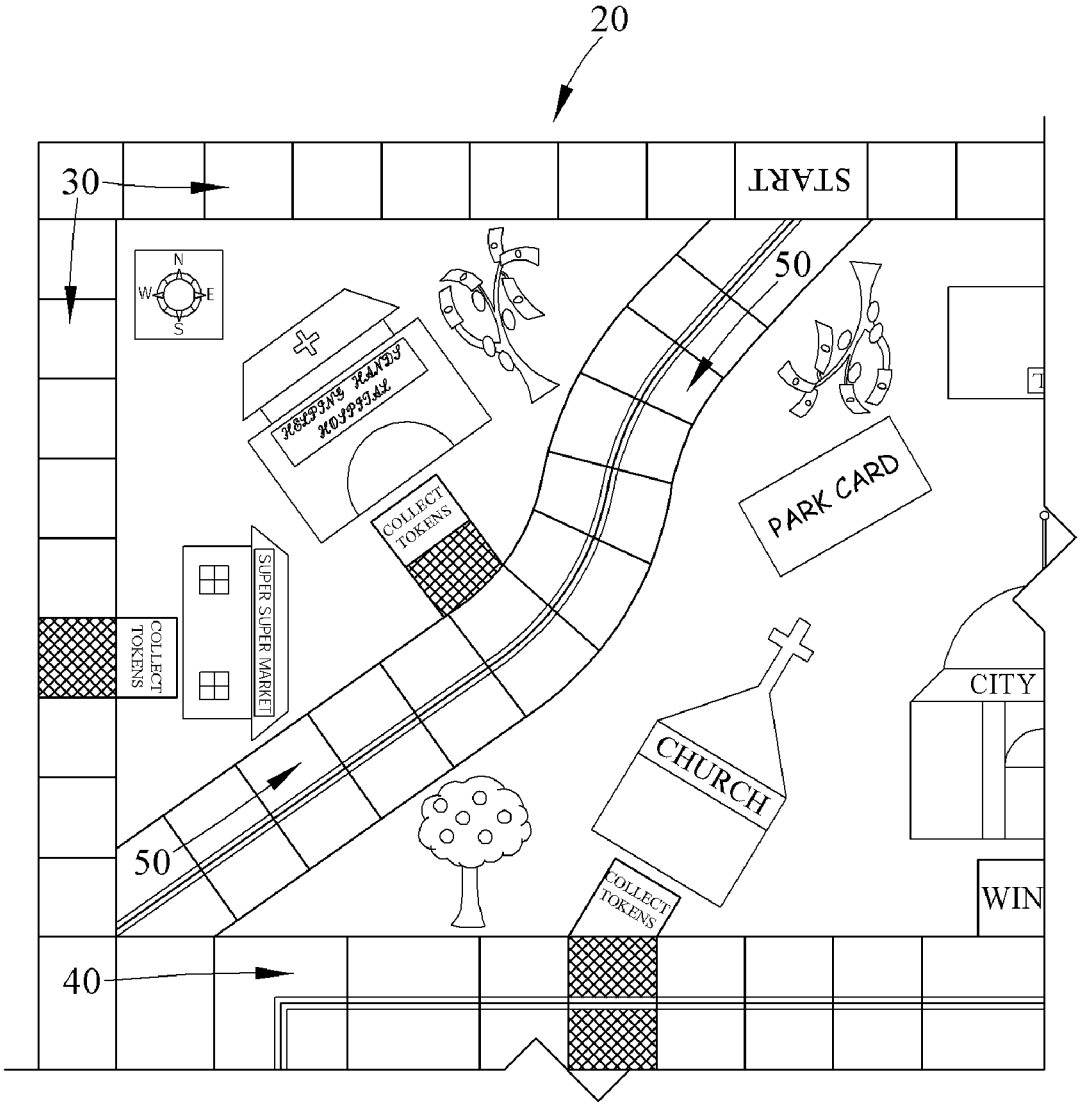
FIG. 7 is a sectional plan view of the game board of FIG. 4 in accordance with one embodiment of the present invention.
Figure 8:
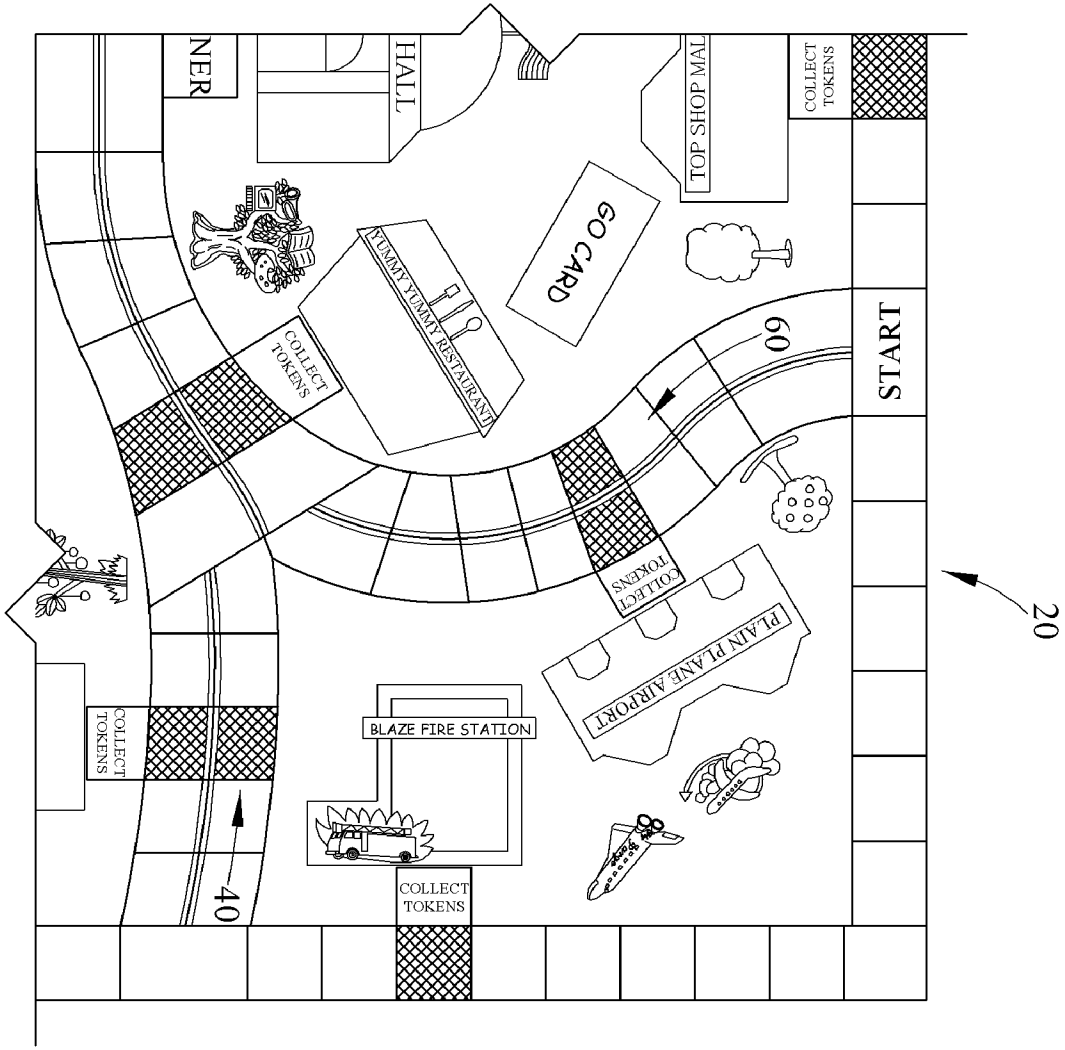
FIG. 8 is a sectional plan view of the game board of FIG. 4 in accordance with one embodiment of the present invention.

Referring to FIGS. 1, 3 and 8 a "MERGING LANE" 60 also intersects with both the PERIMETER ROAD 30 and MAIN STREET 40 and is generally curved in shape. MERGING LANE 60 merges at an oblique angle with MAIN STREET 40. As shown in the drawing Figures, MERGING LANE 60 comprises eight (8) two lane spaces.

A "LOWER ARC" road 70 begins and ends in the two color-coded start spaces 32 disposed on a portion of PERIMETER ROAD 30 and as shown in the drawing Figures, encloses a school building situated along PERIMETER ROAD 30. LOWER ARC ROAD 70 also intersects at two points with an UPPER LOOP Road 80, which is generally curved in a loop shape. An "L-SHAPED STREET" 90 has its origin in an intersection with UPPER LOOP ROAD 80 and terminates at MAIN STREET 40. Finally, CIRCLE DRIVE 100 intersects at two spaces 24 with UPPER LOOP Road 80 and encloses at least one landmark building or locale.

It should be noted that although each street or road on the game board 20 comprises a specific number of spaces 24, the depictions in the drawing Figures are exemplary only, such that more or fewer spaces could be included in each street without departing from the scope and spirit of the present invention.

As can be readily ascertained from the drawing Figures, a plurality of spaces throughout game board 20 are designated as "PARKING AREA" spaces 110, shown generally as cross-hatched on game board 20. Each PARKING AREA 110 space has associated therewith a "COLLECT TOKEN" space 112. Accordingly game board 20 includes seventeen (17) PARKING AREA-110 spaces and seventeen (17) COLLECT TOKEN 112 spaces to which each player must advance prior to winning the game 10.

Figure 10:
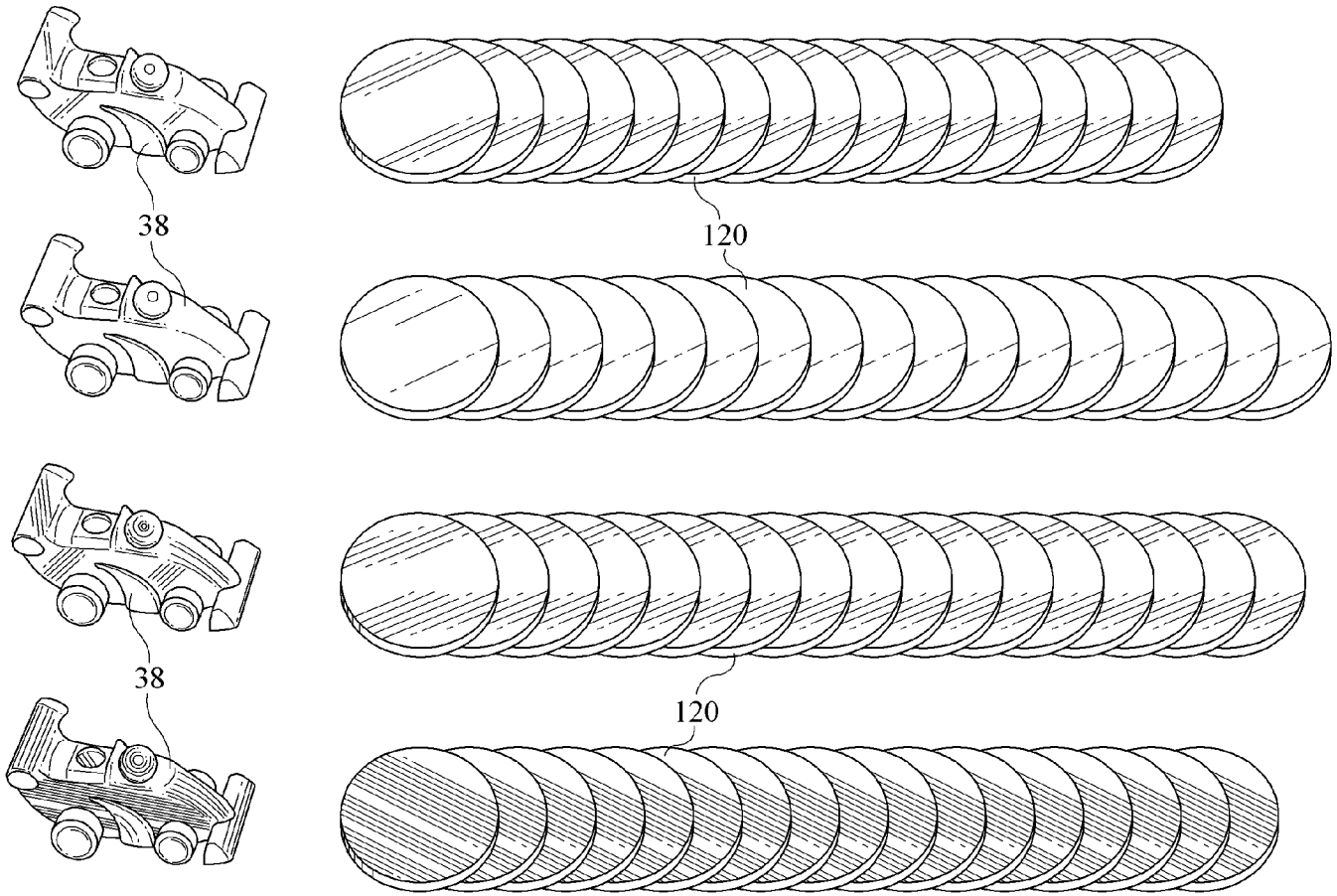
FIG. 10 is an isometric view of game pieces and tokens in accordance with one embodiment of the present invention.

The present invention 10 further comprises a plurality of color-coded tokens 120 shown in FIG. 10, the colors thereof corresponding to the colors of game pieces 38. There are 17 tokens of each individual color, one for each COLLECT TOKEN 112 space. Prior to game play, one token 120 of each color is positioned on or proximate each COLLECT TOKEN 112 space, awaiting the player of the corresponding color to retrieve them during play. Tokens 120 may be formed in a wide variety of shapes and sizes for game play, including but not limited to flat circular tokens that are easily placed on Collect Token 112 spaces.

Several other types of board spaces 24 are employed in the present invention including a plurality of "GO" spaces 130, and a plurality of "PARK" spaces 132. In one embodiment of the invention 10, GO spaces 130 are green and PARK spaces 132 are orange or red in color, as designated in the drawing Figures by the letters "G" and "O" respectively. This color-coded PARK and GO space layout assists in game play for youngsters who are taught from a very young age that a green traffic light corresponds with "GO" while red or orange corresponds with "STOP," or in this case, "PARK."

Game board 20 further comprises a plurality of buildings and landmarks situated in various locations around game board 20. As shown in drawing FIGS. 1 and 3, for example, the game board of the present invention may be configured to place various buildings and landmarks in different locations thereby permitting players to design their own town each time the game is played. The buildings and landmarks used in game 10 include an AIRPORT, a BAKERY, a CHURCH, a CITY HALL, a DENTIST OFFICE, a DOCTOR'S OFFICE, a FIRE STATION, a GAS STATION, a HOSPITAL, a LIBRARY, a MALL, a PARK, a PET SHOP, a POLICE STATION, a RESTAURANT, a SCHOOL, a SUPERMARKET, and a ZOO. Each of these landmarks is situated proximate a COLLECT TOKEN 112 space, with the exception of one landmark which is situated proximate the WINNER space 42. As seen in the drawing Figures, CITY HALL has been chosen to be positioned proximate the WINNER SPACE 42, although any landmark could be employed for this purpose.

As seen in FIG. 11, a plurality of fanciful and humorous banners are included that may be used to label the various landmarks, among them, the "CHERUB CHURCH" the "PLAIN PLANE AIRPORT", and the "TOO COOL SCHOOL". These banners complement the overall appearance of the game board as well as lend a whimsical feel to the town. Finally, a DIRECTIONAL SYMBOL 180 is located in the upper left-hand corner of game board 20, as shown in FIG. 1.

Game board 20 further comprises a PARK CARD space 140 and a GO card space 142 on which are positioned a plurality of PARK and GO CARD, as shown in FIGS. 12-15. When a player lands on a GO space that player is required to select a GO CARD from the top of the deck and follow the instructions printed thereon. Each of the GO CARDS includes a humorous rhyme and/or action that a player must follow. Generally, the GO CARDS are associated with a player's advancement through the game as the instructions printed thereon permit a player to take an action that is generally favorable to advancing through and winning the game.

Additionally, and in accordance with one embodiment of the instant invention, each GO CARD includes a rebus associated with the board location to which the card's instructions pertain. The rebus on each GO CARD enables young children to understand what the GO CARD is instructing them to do, without the necessity of having reading skills, since they may advance to the area of the game board indicated by the rebus. The GO CARDS may be generally green on one side thereof, to correspond to the GO spaces on game board 20. Exemplary GO CARD instructions are shown in FIGS. 12 and 13.

Figure 9:
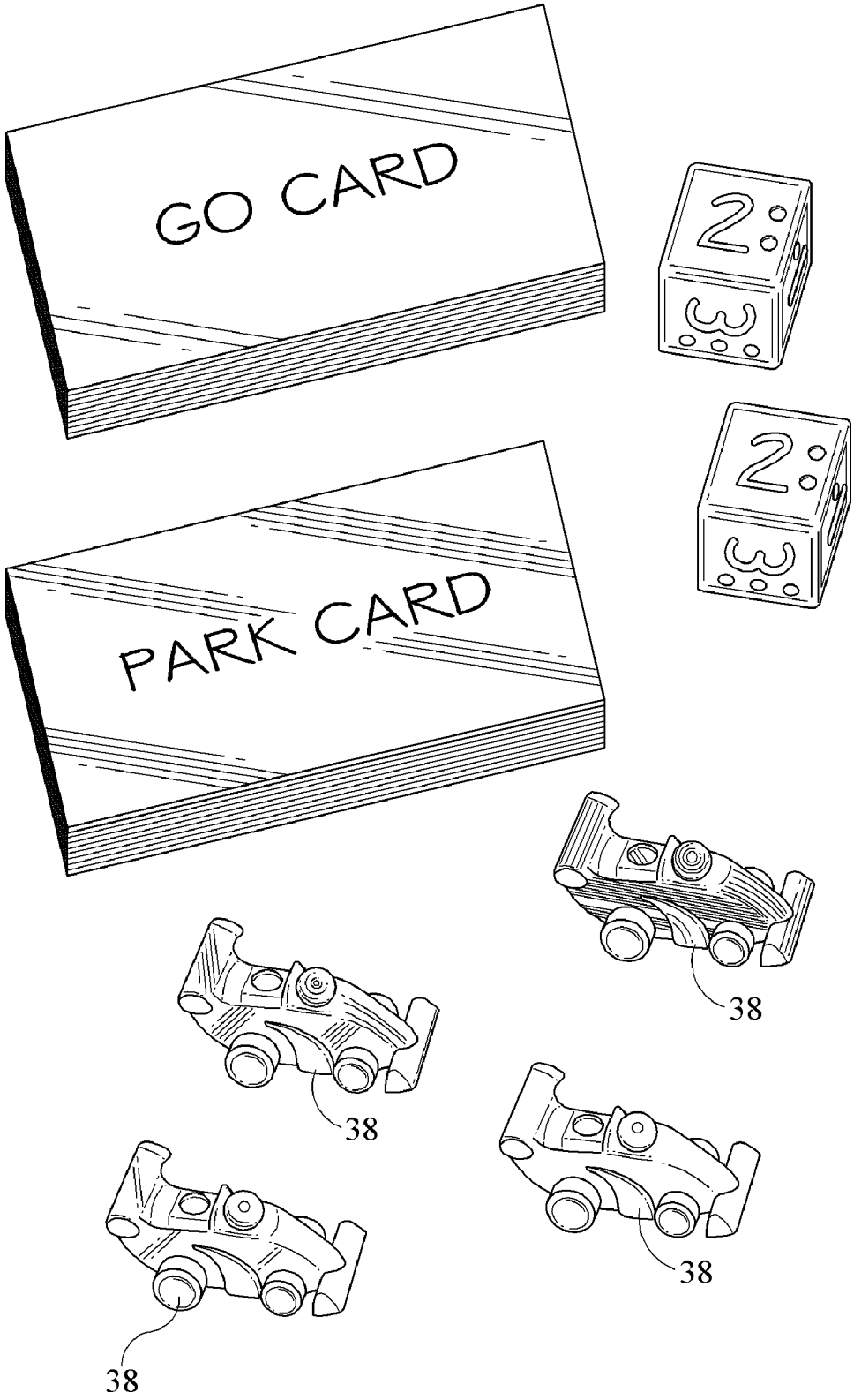
FIG. 9 is an isometric view of game pieces, GO and PARK cards in accordance with one embodiment of the present invention.

Similarly, and as shown in FIGS. 9, 14 and 15, a plurality of PARK CARDS have a large "PARK" indicia on one side thereof and printed instructions and rebus on the other side thereof. The PARK CARDS may be colored orange or red to correspond generally to the red or orange PARK spaces on game board 20. PARK CARDS generally delay or deter a player from advancing in the game. The instructions on PARK CARDS rhyme and are humorous in nature. Exemplary PARK CARD instructions are depicted in FIGS. 14 and 15.

A plurality of fanciful and colorful ornamentations and rebus are provided for the instant invention including, but not limited to trees 150, airplanes 160, school buses 170, police cars 172 and fire trucks 174. These ornamentations may be placed in a variety of locations around game board 20 as desired by the players to enhance the board appearance. Finally a pair of dice is provided, shown in FIG. 9 which the players throw or roll in turn to determine the number of spaces to advance.

When playing the game, two to four players begin by each player in turn rolling the dice to see which player sets off on the town's roads first. The player with the high roll begins first, and each successive player follows the high rolling player in clockwise order around the game board. In the event of a tie, the players who are tied simply roll again until an outcome is determined. The player beginning first selects the color-coded game piece 38 of his or her choice, locates the matching START space 32 on game board 20 and places the game piece there prior to beginning play. Similarly, each player in turn, advancing clockwise around the game board, selects a color-coded game piece 38 and places that piece on the corresponding color-coded START space 32.

Also prior to beginning game 10 play, each player also places one TOKEN 120 of the color corresponding to that player's game piece 38 on or near each landmark associated with a COLLECT TOKEN space 112 which will eventually be collected as the player advances through the game. No TOKEN 120 is placed on the WINNER space 42, shown in FIG. 1 as proximate CITY HALL on MAIN STREET. Additionally, the PARK and GO cards are placed face down in their respective spaces 140 and 142 in preparation for game play.

The ultimate objective of the game, as discussed briefly herein above, is to be the first player to visit each landmark location, collect a TOKEN 120 therefrom, and advance to the WINNER space 42 ahead of the other players. To that end, play is initiated when the first player rolls the dice to determine the number of spaces to move the game piece 38. The player must make strategic decisions during the course of play to determine the most efficient route to take through the game 10 based upon proximity to the target COLLECT TOKEN spaces 112 as well as the intervening GO and PARK spaces along the way. When a player lands on a COLLECT TOKEN space 112 they are entitled to take a token corresponding to the color of their game piece. The roll of the dice is not required to enable a player to move the exact number of spaces necessary to land exactly on the COLLECT TOKEN space 112, but must be sufficient to enable the game piece 38 to reach the COLLECT TOKEN space 112. Once the player collects their TOKEN 120, their turn is over and play moves to the next player clockwise around the game board. Any remaining number of moves left from that dice roll do not carry over to that player's next turn.

If the dice roll enables a player to land exactly on a green GO space, then that player must select a corresponding GO card from the top of the stack and follow the direction thereon. Similarly, if the dice roll enables a player to land exactly on an orange PARK space, then that player must select a corresponding PARK card from the top of the stack and follow those directions. Once used, the PARK and GO cards are placed on the bottom of their respective stacks. In the event that the instructions on the PARK or GO card require a player to move their game piece 38 to another green GO or orange PARK space, the player is not entitled to select another card at that point. Rather, their turn is over, and they must wait until the other players take a turn to continue. If the PARK or GO card instructs a player to advance to a specific COLLECT TOKEN space 112, they must advance their game piece 38 to that space even if they already have the TOKEN 120 corresponding to that space.

Once a player collects each TOKEN 120 of his or her color, they must then advance to the WINNER space 42 at CITY HALL to win the game. It should be noted that a player need not make a roll of the dice that causes them to land exactly on the WINNER space 42. The roll only needs to be sufficient to advance them to the WINNER space 42 to win the game. In an alternative embodiment of the present invention, the first player to play can, at their sole discretion, decide to declare DOUBLES play throughout the game. In this event, whenever a player rolls a double number with the dice, they are entitled to a second turn after their first is completed.

In a yet further embodiment of the present invention, the landmark buildings, locales and ornamentations included with the game board 20 of the present invention 10 are provided separately from game board 20 and are constructed of a foam or plastic material, rather than printed on the game board 20 as is common in prior art board games. The landmark buildings may include various combinations of building bases and roofs, all of varying colors and fanciful patterns, thereby enabling players to construct a unique town in which the game 10 is played.

Furthermore, a plurality of board ornamentations or decorations that may be comprised of foam or plastic material are included with the instant invention that permit players to exercise their creativity in placing the ornamentations on game board 20. In one embodiment of the present invention, the buildings and ornamentations are constructed of a material that enables electrostatic adhesion to the game board 20 to enable the various buildings and ornamentations to remain in place if game board 20 is bumped or jostled.

Figure 2:
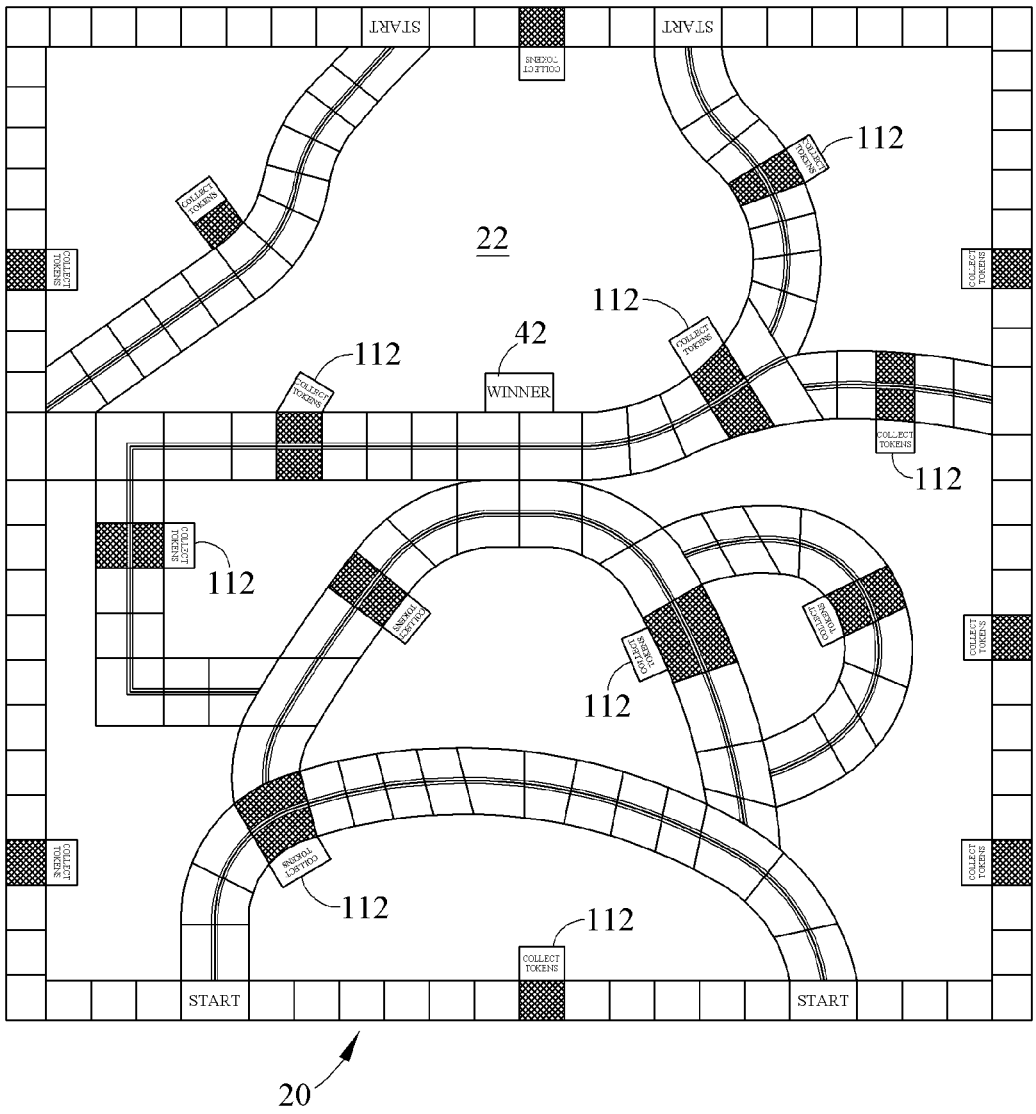
FIG. 2 is a plan view of a game board devoid of landmarks in accordance with one embodiment of the present invention.

As best shown in FIG. 2, in this embodiment of the invention 10 a game board 20 may be provided that includes only the roads and the COLLECT TOKEN spaces 112 and WINNER 42 spaces integral thereto. The players may then construct the various buildings and place ornamentations around the game board 20 to complete the playing surface 22. FIG. 3 depicts a game board having a plurality of constructed buildings placed at varying locations along the board 20. Note that CITY HALL remains proximate the WINNER space 42 on MAIN STREET 40. As seen in FIGS. 1 and 3 many of the buildings placed around the game board 20 have a rebus thereon that enables younger players to engage in game play since they can easily recognize the landmark to which they must advance or retreat, or on which they must remain, according to the instructions on the PARK and GO CARDS.

Additionally, FIGS. 4-8 depict the game board 20 construction of FIG. 3 with additional ornamentations placed thereon. Ornamentations that may be employed according to the players' imagination in this embodiment of the present invention include, but are not limited to, money trees 200, lollipop trees 202, trees of knowledge 204, ordinary green trees 206, a variety of animals such as monkeys, lions, dogs, giraffes, bears, snakes, a flag such as an American flag or state flag, and a variety of conveyances such as airplanes, helicopters, police cars, fire trucks, and school buses.

Finally, a playground or ball field ornament may be provided to complement and enhance the park. One of ordinary skill in the art will recognize that a wide variety of ornamental symbols may be employed with the game 10 of the present invention. The ultimate configuration of game board 20 in this embodiment of the invention is limited only by the imaginations and cooperative efforts of the players.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

We claim:

1. A board game wherein players construct and advance through a customizable simulated town consisting of:

a game board having a playing surface, said game board comprising:

a plurality of spaces including at least one starting space and a winner space, said plurality of spaces defining a perimeter road proximate the perimeter of said game board and a plurality of intersecting roads through the interior of said game board;

a plurality of symbolic buildings comprising at least one base piece that must be placed at any one of a plurality of different locations proximate any of said road spaces of said game board by said players, wherein said buildings are constructed by said players from said at least one base piece, said base pieces comprising components of buildings that are representative of landmark features of a town;

a plurality of symbolic locales that must be placed at any one of a plurality of different locations proximate any of said plurality of road spaces of said game board by said players; the locales representative of landmark features of a town;

a plurality of color-coded game pieces for representing a player's position on said game board;

a plurality of color-coded game tokens corresponding to said color-coded game pieces for marking when a player has advanced to a building or locale;

a plurality of GO cards comprising printed instructions and visual indicia representative of a road space to which a player is entitled to advance;

a plurality of PARK cards comprising printed instructions and visual indicia representative of a road space on which a player must remain or to which a player must retreat; and a plurality of ornamental features comprising:

a plurality of miniature trees;

a plurality of miniature animals;

a plurality of miniature airplanes;

a plurality of miniature school buses at least one police car;

at least one fire truck;

at least one flag;

a plurality of helicopters; and a directional symbol wherein said ornamental features are arranged by said players to produce said simulated town.

2. A board game as claimed in claim 1 wherein the visual indicia of said plurality of GO and PARK cards comprise a rebus that indicates a portion of the game board to which a player may advance or retreat.

3. A board game as claimed in claim 1 wherein said plurality of symbolic buildings comprise:

an airport, a bakery, a church, a city hall, a dentist office, a doctor's office, a fire station, a gas station, a hospital, a library, a mall, a park, a pet shop, a police station, a restaurant, a school, a supermarket and a zoo.

4. A board game as claimed in claim 1 wherein the plurality of intersecting roads through the interior of said game board comprise:

a main street, an airport highway, a merging lane, a lower are, an upper loop, an L-shaped street, and a circle drive.

5. A board game as claimed in claim 1 wherein said color-coded game pieces comprise miniature vehicles.

6. A board game as claimed in claim 1 wherein said plurality of symbolic buildings are separate from said game board.

7. A board game as claimed in claim 1 wherein said plurality of symbolic locales are separate from said game board thereby enabling them to be located thereon.

8. A board game as claimed in claim 1 wherein said plurality of ornamental features are separate from said game board thereby enabling them to be located thereon.

* * * * *